US009986882B2

(12) United States Patent
Pruitt

(10) Patent No.: US 9,986,882 B2
(45) Date of Patent: Jun. 5, 2018

(54) CENTRAL VACUUM CLEANER FAN MOTOR MOUNT

(71) Applicant: Electrolux Home Care Products, Inc., Charlotte, NC (US)

(72) Inventor: Anthony J. Pruitt, Charlotte, NC (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 0 days. days.

(21) Appl. No.: 15/406,882

(22) Filed: Jan. 16, 2017

(65) Prior Publication Data

US 2017/0119224 A1 May 4, 2017

Related U.S. Application Data

(63) Continuation of application No. 14/804,663, filed on Jul. 21, 2015, now Pat. No. 9,579,004, which is a (Continued)

(51) Int. Cl.
*A47L 9/22* (2006.01)
*A47L 9/00* (2006.01)
(Continued)

(52) U.S. Cl.
CPC *A47L 9/22* (2013.01); *A47L 5/38* (2013.01); *A47L 9/0081* (2013.01); *E06B 5/00* (2013.01); *E06B 7/18* (2013.01)

(58) Field of Classification Search
CPC . A47L 5/38; A47L 5/00; A47L 9/0081; A47L 9/22; E06B 5/00; E06B 7/16; E06B 7/28
See application file for complete search history.

(56) References Cited

U.S. PATENT DOCUMENTS 2,726,889 A 12/1955 Lawson
2,804,329 A 8/1957 Landis
(Continued)

FOREIGN PATENT DOCUMENTS

DE 4031123 A1 4/1992
EP 1938735 A2 7/2008
(Continued)

OTHER PUBLICATIONS

Entire patent prosecution history of U.S. Appl. No. 13/294,424, filed Nov. 11, 2011, entitled "Latch Assembly for a Vacuum System," now U.S. Pat. No. 9,978,550, issued Jul. 14, 2015, 1 page.
(Continued)

*Primary Examiner* — Dung Van Nguyen
(74) *Attorney, Agent, or Firm* — RatnerPrestia

(57) ABSTRACT

A central vacuum cleaner having a main housing, a suction chamber located inside the main housing, a shelf extending from the main housing into the suction chamber, a suction chamber inlet providing a fluid passage through the main housing into the suction chamber, a suction motor having a suction motor inlet in fluid communication with the suction chamber and configured to generate a flow of air from the suction chamber inlet to the suction chamber and into the suction motor inlet, a mounting flange extending from the suction motor towards the main housing, and a number of clamps. Each clamp is movably mounted to the mounting flange and has a first end movable between a locked position in which the shelf is held between the first end and the mounting flange, and an unlocked position in which the shelf is not held between the first end and the mounting flange.

22 Claims, 10 Drawing Sheets

Related U.S. Application Data continuation of application No. 13/744,804, filed on Jan. 18, 2013, now Pat. No. 9,131,816.

(51) Int. Cl.

| | |
|---|---|
| ***A47L 5/38*** | (2006.01) |
| ***E06B 7/18*** | (2006.01) |
| ***E06B 5/00*** | (2006.01) |

(56) References Cited

U.S. PATENT DOCUMENTS

| | | | | |
|---|---|---|---|---|
| 5,292,158 | A | 3/1994 | Kurosaki | |
| 5,370,259 | A | 12/1994 | Cartigny | |
| 5,400,463 | A | 3/1995 | Attard et al. | |
| 5,404,614 | A | 4/1995 | Stephens | |
| 5,737,797 | A * | 4/1998 | Rittmueller | A47L 5/38 15/314 |
| 6,698,059 | B2 | 3/2004 | Biere et al. | |
| 6,712,868 | B2 | 3/2004 | Murphy et al. | |
| 6,779,228 | B2 * | 8/2004 | Plomteux | A47L 5/38 15/314 |
| 7,080,425 | B2 * | 7/2006 | Smith | A47L 5/38 15/314 |
| 7,287,301 | B2 | 10/2007 | Marshall et al. | |
| 7,441,813 | B2 | 10/2008 | Qin et al. | |
| 7,461,430 | B2 | 12/2008 | Reick-Mitrisin et al. | |
| 2005/0039295 | A1 | 2/2005 | Werning | |
| 2006/0016044 | A1 * | 1/2006 | Wiedemann | A47L 9/127 15/353 |
| 2006/0150360 | A1 | 7/2006 | Reick-Mitrisin et al. | |
| 2007/0067948 | A1 * | 3/2007 | Biere | A47L 5/38 15/412 |
| 2008/0016646 | A1 * | 1/2008 | Gagnon | A47L 5/38 15/301 |
| 2009/0193610 | A1 * | 8/2009 | Gabric | A47L 5/38 15/314 |
| 2010/0199454 | A1 | 8/2010 | Pruitt et al. | |
| 2013/0117958 | A1 * | 5/2013 | Pruitt | A47L 5/38 15/301 |
| 2013/0180078 | A1 | 7/2013 | Cleary | |

FOREIGN PATENT DOCUMENTS

| | | | |
|---|---|---|---|
| EP | 1997411 | A2 | 12/2008 |
| WO | 2008121114 | A1 | 10/2008 |

OTHER PUBLICATIONS

Entire patent prosecution history of U.S. Appl. No. 12/700,482, filed Feb. 4, 2010, entitled, "Latch Assembly for a Vacuum System", 1 page.

Entire patent prosecution history of U.S. Appl. No. 13/744,804, filed Jan. 18, 2013, entitled "Central Vacuum Cleaner Apparatus," now U.S. Pat. No. 9,131,816, issued Sep. 15, 2015, 1 page.

European Patent Application Office Action for Application No. 10 152 843.8-1712, dated Oct. 31, 2013, 6 pages.

European Search Report based on EP 10152843.8-2316, dated Jan. 31, 2013, 7 pages.

International Preliminary Report on Patentability for PCT International Application No. PCT/US2012/063805, dated May 14, 2015, 5 pages.

International Search Report and Written Opinion of PCT/US2012/063805, Blaine R. Copenheaver, Authorized Officer, dated Jan. 24, 2013, 11 pages.

International Search Report for PCT Application No. PCT/US2014/11210, dated May 5, 2014, 5 pages.

Preliminary Report on Patentability and Written Opinion for International Application No. PCT/US2014/011210, dated Jul. 30, 2015, 5 pages.

U.S. Appl. No. 13/294,424, filed Nov. 11, 2011, "Latch Assembly for a Vacuum System," Anthony Pruitt et al., 26 pages.

* cited by examiner

CENTRAL VACUUM CLEANER FAN MOTOR MOUNT

This application is a continuation of U.S. application Ser. No. 14/804,663, filed Jul. 21, 2015, which is a continuation of U.S. application Ser. No. 13/744,804, filed on Jan. 18, 2013 and issued as U.S. Pat. No. 9,131,816, the entire contents of both of which are incorporated herein by reference.

BACKGROUND OF THE INVENTION

1. Field of the Invention

The present invention relates to utility suction ports for use with central vacuum cleaners or other vacuum cleaners.

2. Description of the Related Art

Central vacuum cleaner systems use a vacuum source at a single location within a house or other structure to perform cleaning throughout the structure through a network of interconnected suction pipes. In houses, the central vacuum cleaner is often mounted in a utility room or garage, and the pipes are concealed within the structure's walls. Local cleaning ports are provided at the ends of the pipes, and cleaning implements such as hoses and the like are selectively connected to the ports to perform cleaning operations.

Central vacuum cleaners offer some benefits over other kinds of vacuum cleaners. For example, during use it is only necessary to manipulate a hose and the cleaning tool, instead of having to move the suction source as required with other kinds of vacuum cleaner, resulting in less user fatigue. Central vacuum cleaners also isolate the operator from much of the noise generated by the suction motor. Also, a heavier and more powerful suction motor may be used because it is not necessary to move it during use. Another benefit is that central vacuums also often have large dirt-holding capacity and require less frequent emptying.

While central vacuums have been well-accepted, there still exists a need to improve or provide alternative arrangements for the various central vacuum cleaner components. For example, further reductions in operating noise and simplification of sound-reducing systems are desirable. It is also desirable to make central vacuum cleaner systems easier to manufacture and service, and to improve operating performance.

SUMMARY

In one exemplary embodiment, there is provided a central vacuum cleaner having a main housing, a suction chamber located inside the main housing, a shelf extending from the main housing into the suction chamber, a suction chamber inlet providing a fluid passage through the main housing into the suction chamber, a suction motor having a suction motor inlet in fluid communication with the suction chamber and configured to generate a flow of air from the suction chamber inlet to the suction chamber and into the suction motor inlet, and at least one clamp operatively associated with the suction motor and configured to releasably engage the shelf to connect the suction motor to the main housing.

The at least one clamp may include three clamps equally spaced around a perimeter of the suction motor within the main housing. A mounting flange may extend from the suction motor towards the main housing, and the at least one clamp may be positionable to hold the shelf between the at least one clamp and the mounting flange to connect the suction motor to the main housing. A mounting flange gasket may be positioned between the mounting flange and the main housing to form a leak resistant seal between the suction chamber and an upper portion of the main housing. The at least one clamp may have a resilient member positioned adjacent the shelf when the clamp is positioned to hold the shelf between the at least one clamp and the mounting flange, the resilient member and the mounting flange gasket being selected from one or more materials to reduce transmission of vibrations from the suction motor to the main housing.

The at least one clamp may be a rocker arm connected to the mounting flange at a pivot, the rocker arm being pivotable between a locked position in which the shelf is held between the a first end of the rocker arm and the mounting flange, and an unlocked position in which the shelf is not held between the first end of the rocker arm and the mounting flange. The at least one clamp may include a screw threaded into one or the other of the mounting flange and the rocker arm, and positioned to move the rocker arm from the unlocked position to the locked position upon rotation of the screw. The screw may be threaded in a hole in the mounting flange and positioned to contact a second end of the rocker arm. The rocker arm may be positioned on a first side of the mounting flange, the screw may extend through the mounting flange to a second side of the mounting flange, and the screw may be operable from the second side of the mounting flange. The first side of the mounting flange may be located in the suction chamber, and the second side of the mounting flange may be located outside the suction chamber. The mounting flange may be located above the shelf and the clamp may be located below the shelf when the at least one clamp is positioned to hold the shelf between the at least one clamp and the mounting flange to connect the suction motor to the main housing.

In another exemplary embodiment, there is provided a central vacuum cleaner having a main housing, a suction chamber located inside the main housing, a shelf extending from the main housing into the suction chamber, a suction chamber inlet providing a fluid passage through the main housing into the suction chamber, a suction motor having a suction motor inlet in fluid communication with the suction chamber and being configured to generate a flow of air from the suction chamber inlet to the suction chamber and into the suction motor inlet, a mounting flange extending from the suction motor towards the main housing, and a plurality of clamps. Each clamp is movably mounted to the mounting flange and has a first end movable between a locked position in which the shelf is held between the first end and the mounting flange, and an unlocked position in which the shelf is not held between the first end and the mounting flange.

A mounting flange gasket may be positioned between the mounting flange and the main housing to form a leak resistant seal between the suction chamber and an upper portion of the main housing. Each of the clamps may have a resilient member positioned at the first end and adjacent the shelf when the clamp is in the locked position. Each of the clamps may be a rocker arm connected to the mounting flange at a pivot. Each of the clamps may have a screw threaded into one or the other of the mounting flange and the rocker arm, and positioned to move the rocker arm from the unlocked position to the locked position upon rotation of the screw. The screw may be threaded in a hole in the mounting flange and positioned to contact a second end of the rocker arm. The rocker arm may be positioned on a first side of the mounting flange, the screw may extend through the mounting flange to a second side of the mounting flange, and the screw may be operable from the second side of the mounting flange. The first side of the mounting flange may be located in the suction chamber, and the second side of the mounting flange may be located outside the suction chamber. The mounting flange may be located above the shelf and the clamp may be located below the shelf when the plurality of clamps are in the locked position.

A pliable gasket may be interposed between the suction motor and the mounting flange.

The suction motor may be enclosed within a motor housing, the mounting flange may extend outward from the motor housing, and the motor housing, mounting flange and suction motor may be removable as a unit from the main housing when the plurality of clamps are in the unlocked position.

The recitation of this summary of the invention is not intended to limit the claims of this or any related or unrelated application. Other aspects, embodiments, modifications to and features of the claimed invention will be apparent to persons of ordinary skill in view of the disclosures herein.

BRIEF DESCRIPTION OF THE DRAWINGS

A better understanding of the exemplary embodiments may be understood by reference to the attached drawings, in which like reference numbers designate like parts. The drawings are exemplary and not intended to limit the claims in any way.

DETAILED DESCRIPTION

Figure 1:
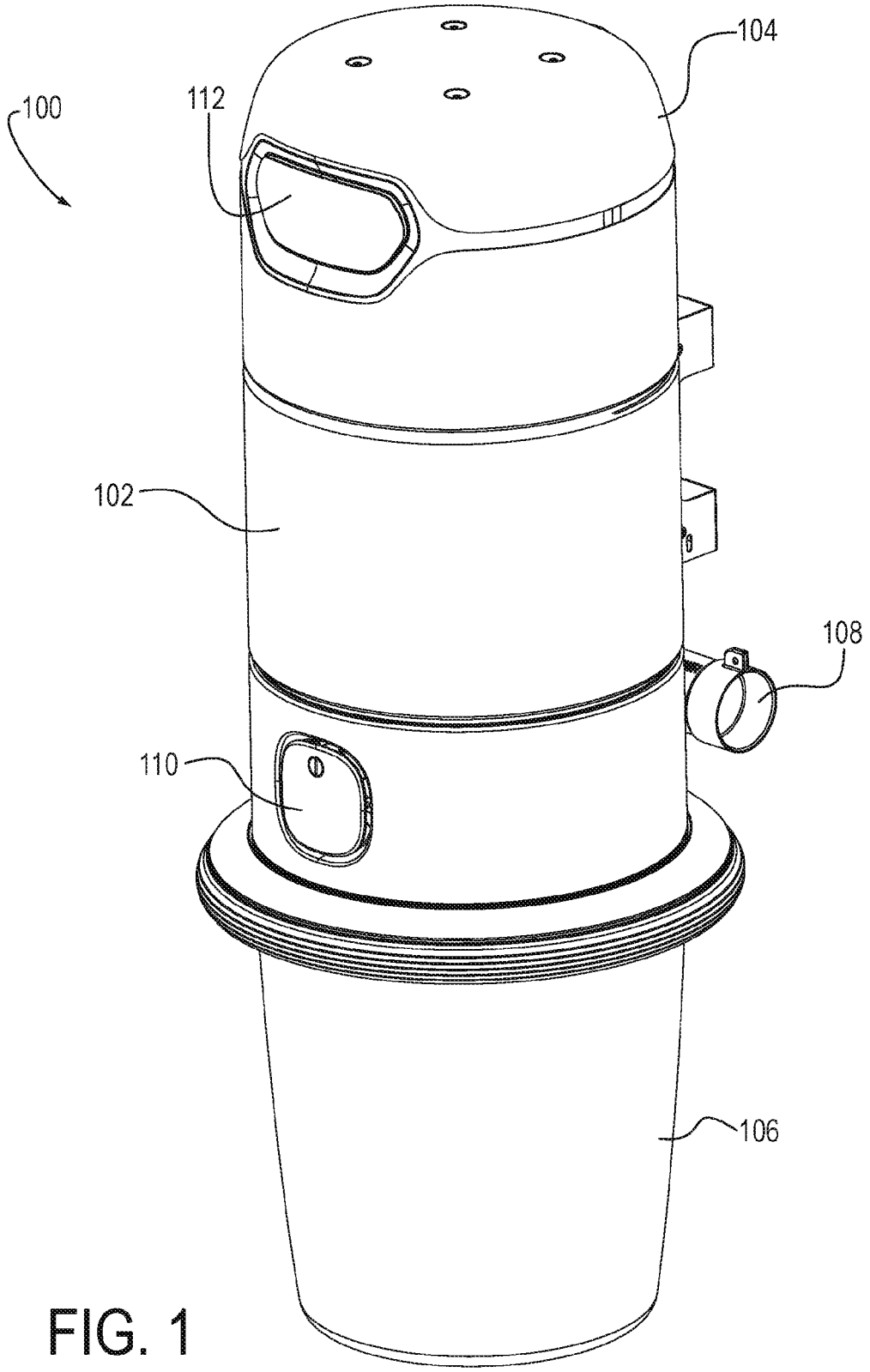
FIG. 1 is an isometric view of an exemplary central vacuum cleaner module.
Figure 2:
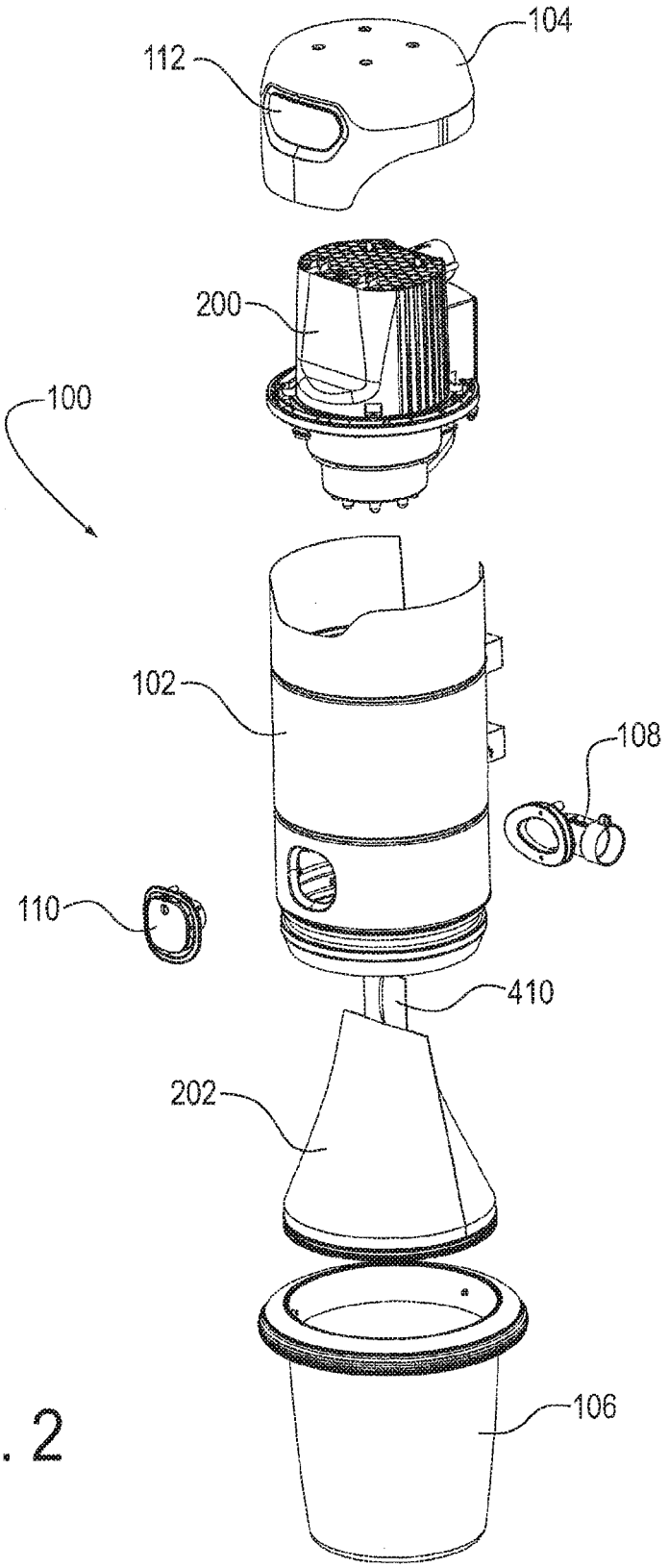
FIG. 2 is an exploded view of the central vacuum cleaner module of FIG. 1.

An exemplary embodiment of a central vacuum cleaner module 100 is shown in FIGS. 1 and 2. In general terms, the cleaner module 100 is configured for permanent connection within a house or other structure, using conventional straps or other mounting hardware. A system of suction pipes (not shown) connects one or more cleaner module inlets to a number of ports located throughout the structure. Cleaning implements, such as powerheads, floor nozzles, and the like, are selectively connected to the ports to place them in fluid communication with the cleaner module 100. A control system, such as a wired or wireless electronic controller or a sound wave controller, is used to selectively activate and deactivate a suction motor (i.e., an electric motor connected to a suction fan) located within the cleaner module 100 to initiate and cease a suction flow of air through the remote cleaning implements. The suction air draws in dirt and coveys it to a dirt separator located within the cleaner module 100. Typical dirt separators include bag filters and cyclonic separators.

The exemplary cleaner module 100 includes a main housing 102, an upper cover 104, and a dirt receptacle 106 at the bottom of the main housing 102. The upper cover 104 encloses a motor module 200 that is mounted to the main housing 102, and may include cooling air ports, suction air exhaust ports, and the like. The shown embodiment uses a single upper cover 104, but multiple separate covers of various shapes and sizes may be used as necessary to shield the operating components. The dirt receptacle 106, which may be transparent or opaque, may be removably mounted to the bottom of the main housing 102, or a permanent installation that has an access port to remove accumulated dirt. Example of a removable dirt receptacles 106 are shown in U.S. patent application Ser. Nos. 12/700,482 and 13/294,424, which are incorporated herein by reference. If the dirt receptacle 106 is removable, any suitable latch may be used to connect the dirt receptacle 106 to the main housing 102.

One or more main suction chamber inlets 108 connect the cleaner module 100 to a network of suction pipes distributed throughout the structure in which the cleaner module 100 is mounted. In the shown embodiment, the main suction chamber inlet 108 directs air into a suction chamber located above the dirt receptacle 106. The main suction chamber inlet 108 may direct the air perpendicular or at an angle (e.g., tangentially) into the suction chamber, and may include a baffle to redirect the incoming airflow, as known in the art. The air is drawn upwards to the motor module 200, and a filter bag 202 is located in the air path to the motor module 200 to remove dirt from the air. During operation, heavier dirt may fall into the dirt receptacle 106, and when the suction motor 300 is turned off, dirt pressed against the filter bag 202 by the suction air flow also drops into the dirt receptacle 106. The exemplary filter bag 202 is mounted at its perimeter, and the center of the filter bag 202 is free to rise when the suction airflow is applied and drop down towards the dirt receptacle 106 when suction ceases, which may help dislodge dirt. It will be appreciated that other embodiments may use other devices to remove the dirt from the air, such as one or more rigid filters, cyclone separators, or other kinds of inertial separators.

If desired, a utility port 110, such as described subsequently herein, may be provided on the cleaner module 100 to connect to a hose to perform local cleaning around the cleaner module 100. Other features also may be provided. For example, the cleaner module 100 also may include one or more cosmetic covers, control panels 112, indicator lights, wall mounting bosses or clamps, and so on.

Figure 3:
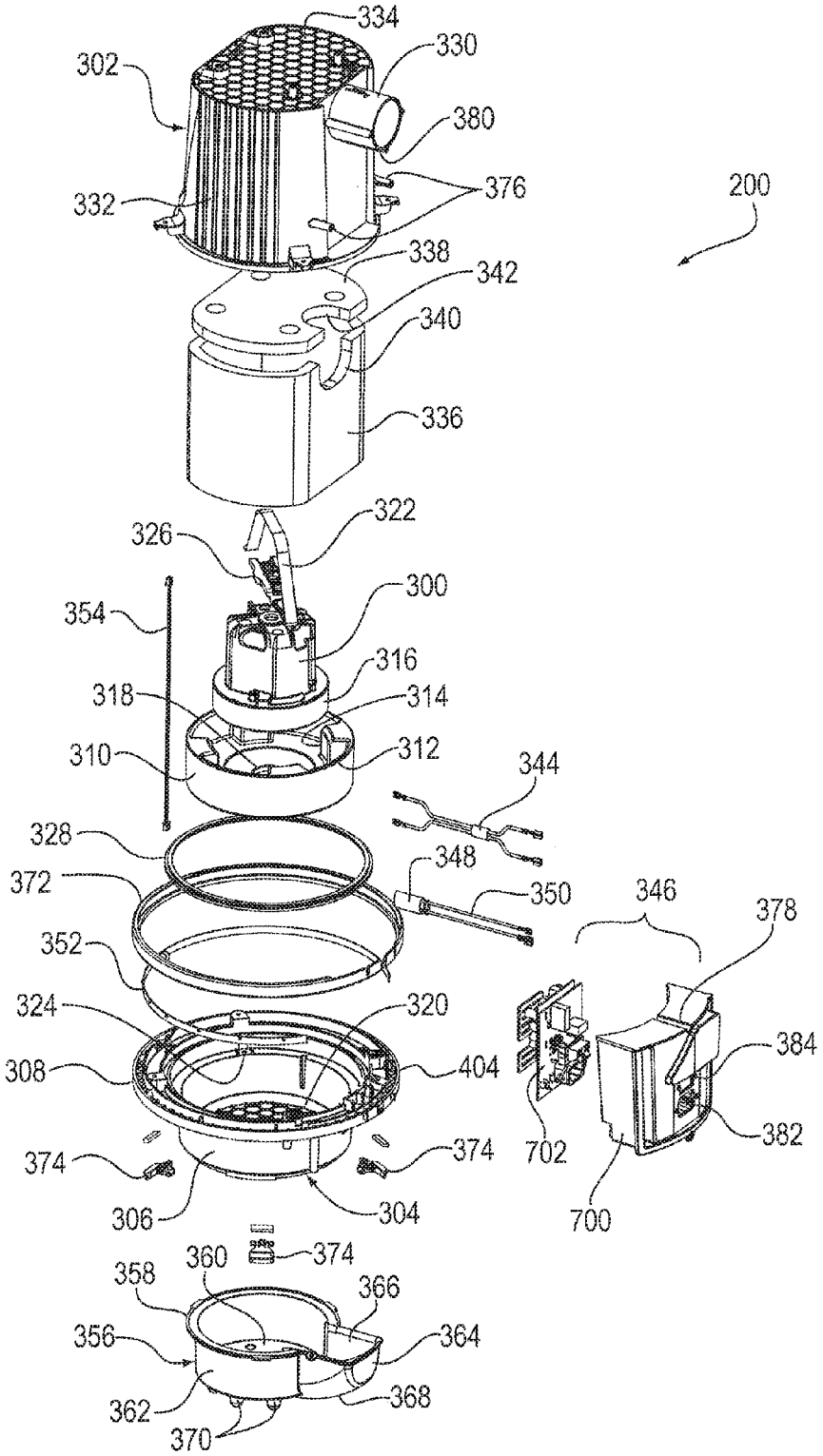
FIG. 3 is an exploded view of an exemplary motor module for a central vacuum cleaner module.
Figure 4:
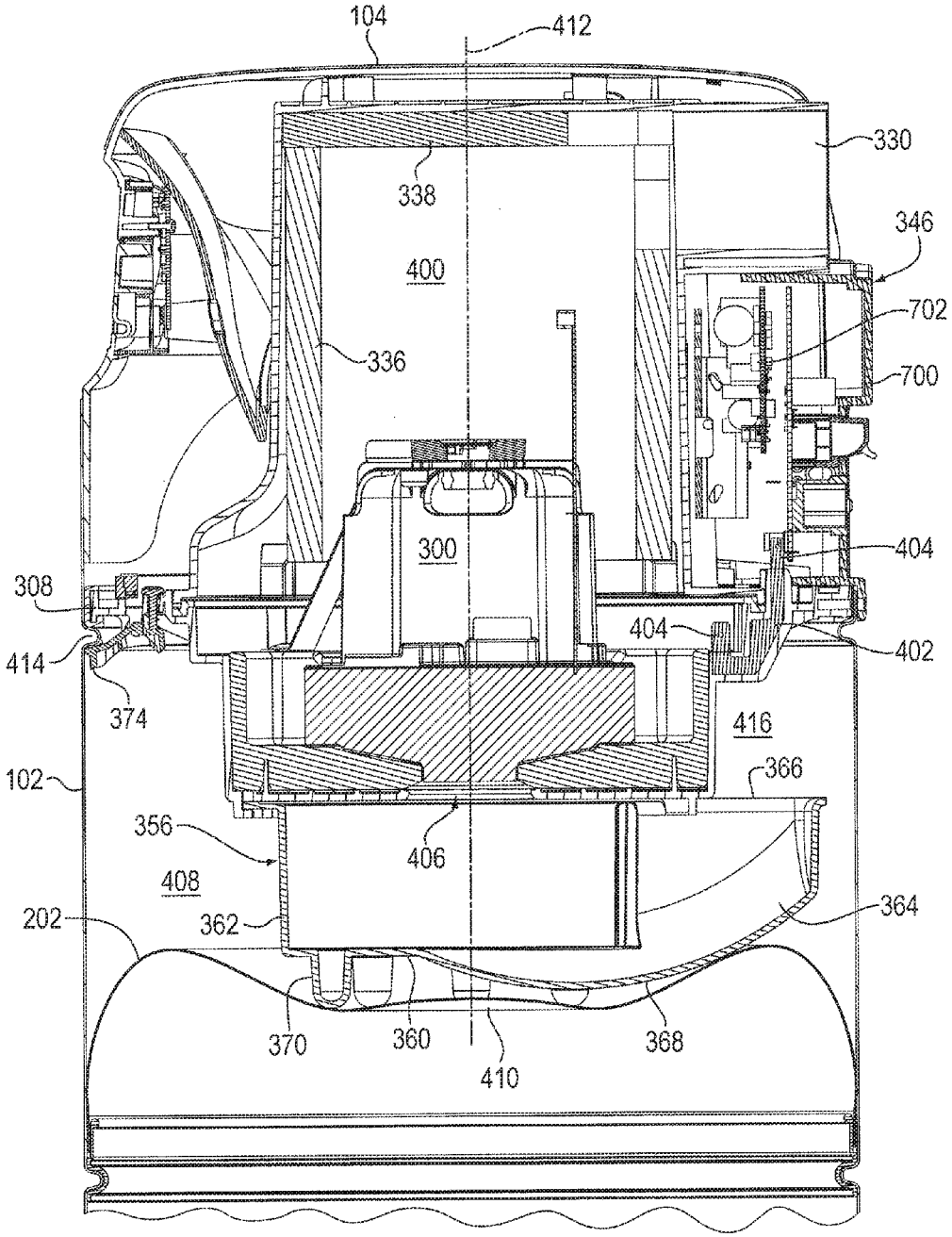
FIG. 4 is a cross-sectional side view of the motor module of FIG. 3 mounted in the central vacuum cleaner module of FIG. 1.

Referring to FIGS. 3 and 4, the motor module 200 includes a suction motor 300 that is contained within an enclosure formed by an upper motor housing shell 302 and a lower motor housing shell 304. The lower motor housing shell 304 includes a cup-like recess 306 and a mounting flange 308 that extends radially from the recess 306. The lower end of the suction motor 300 fits within the recess 306, with a lower motor gasket 310 interposed between the suction motor 300 and the recess. The lower motor gasket 310 preferably comprises a somewhat pliable material, such as polyurethane, that absorbs vibrations generated by the suction motor 300 and helps reduce operating noises. In the shown embodiment, the lower motor gasket 310 comprises an outer wall 312 that is spaced from the suction motor 300 and fits snugly within the recess 306, and a number (e.g., four) of inward extensions 314 that join the outer wall 312 to the outer perimeter of the suction motor 300. In this case, the inward extensions 314 abut a impeller shroud 316 that surrounds the suction motor's fan element. The shape, number and size of the inward extensions 314 may be modified to vary the stiffness of the connection between the suction motor 300 and the recess 306.

The bottom of the lower motor gasket 310 is mostly solid but includes an inlet hole 318 that surrounds a corresponding suction inlet into the impeller shroud 316. The bottom of the lower motor gasket 310 lies against a lower wall 320 of the recess 306. The lower wall 320 includes one or more openings (in this case it is formed as a honeycomb of openings) that are aligned with the inlet hole 318. Thus, air is free to pass through the lower motor housing shell 304 and lower motor gasket 310 and into the suction motor 300. However, the remainder of the lower motor gasket 310 may be configured to prevent airflow from passing into the suction inlet by other paths. Thus, the lower motor gasket 310 may provide a sealing function in addition to the above-noted vibration-reducing function.

The suction motor 300 may be retained on the lower motor housing shell 304 by one or more connectors, such as a bracket 322. The exemplary bracket 322 comprises a strap-like metal or plastic structure that passes over the upper end of the suction motor 300. Each end of the bracket 322 is connected by screws or other fasteners to the lower motor housing shell 304 at, for example, two mounting bosses 324 located on opposite sides of the recess 306. An upper motor gasket 326 may be provided between the bracket 322 and the top of the suction motor 300 to help reduce vibrations from passing from the suction motor 300 to the bracket 322.

The foregoing arrangement is expected to suppress operating noise by mounting the suction motor 300 exclusively to the lower motor housing shell 304 and not to other parts (e.g., the upper motor housing shell 302) that might more readily transmit operating noises to the outside environment. Mounting the suction motor 300 to the lower motor housing shell 304 also provides some advantages to assembling the parts. However, alternative embodiments may use other arrangements to mount the suction motor 300. For example, the suction motor 300 may be connected to the upper motor housing shell 302, either exclusively or in addition to being mounted to other parts.

The upper motor housing shell 302 is connected to the lower motor housing shell 304 by one or more screws or other fasteners. A motor housing gasket 328 may be interposed between the upper and lower motor housing shells 302, 304 to seal the motor module 200 at this junction. The upper motor housing shell 302 surrounds the high-pressure (i.e., outlet) side of the suction motor 300, and includes an air outlet 330 through which air passing through the suction motor 300 eventually leaves the motor module 200. In the exemplary embodiment, the upper motor housing shell 302 has an upwardly-extending sidewall 332 and a generally flat top wall 334, and the air outlet 330 is provided at or near the top of the sidewall 332.

Resonant frequencies can develop in the sidewall 332 and top wall 334, particularly if these parts are relatively flexible. As such, the sidewall 332 and top wall 334 may include reinforcing structures or engineered shapes to stiffen them. For example, the sidewall 332 and top wall 334 may include stiffening ribs. It has been found that a honeycomb grid of reinforcing ribs extending from the top wall 334 is helpful to reduce increase the top wall's stiffness and reduce resonation and sound emitted from the top wall 334.

The upper motor housing shell 302 directs the airflow to an air outlet 300, which may be connected to an exhaust system. The upper motor housing shell 302 may include internal baffles or passages to redirect the airflow as it passes from the suction motor 300 to the air outlet 330, but in the exemplary embodiment it comprises an open chamber 400, such as shown in FIG. 4. The inner walls of the upper motor housing shell 302 may be lined with sound-absorbing material, such as a layer of polyurethane foam having a thickness of about 0.5 inches with a 1/16-inch PVC barrier. The exemplary embodiment includes a first foam layer 336 that lines the sidewall 332, and a second foam layer 338 that lines the top wall 334. These layers 336, 338 may be provided as an assembly of separate foam pads, or as a unitary foam structure. The first and second foam layers 336, 338 may include one or more openings to allow air to freely pass through the air outlet 330. For example, the first and second foam layers 336, 338 may include respective cutouts 340, 342 that surround the air outlet 330. The foam layers 336, 338 also may include other features, such as sound-reducing conical protrusions or other shapes, regions of increased or reduced thickness, or holes to affect the propagation of sound waves. Post-motor filters, mufflers, air diffusers, outlet pipes, and the like may be connected to the air outlet 330 to clean, redirect or silence the airflow.

Figure 6:
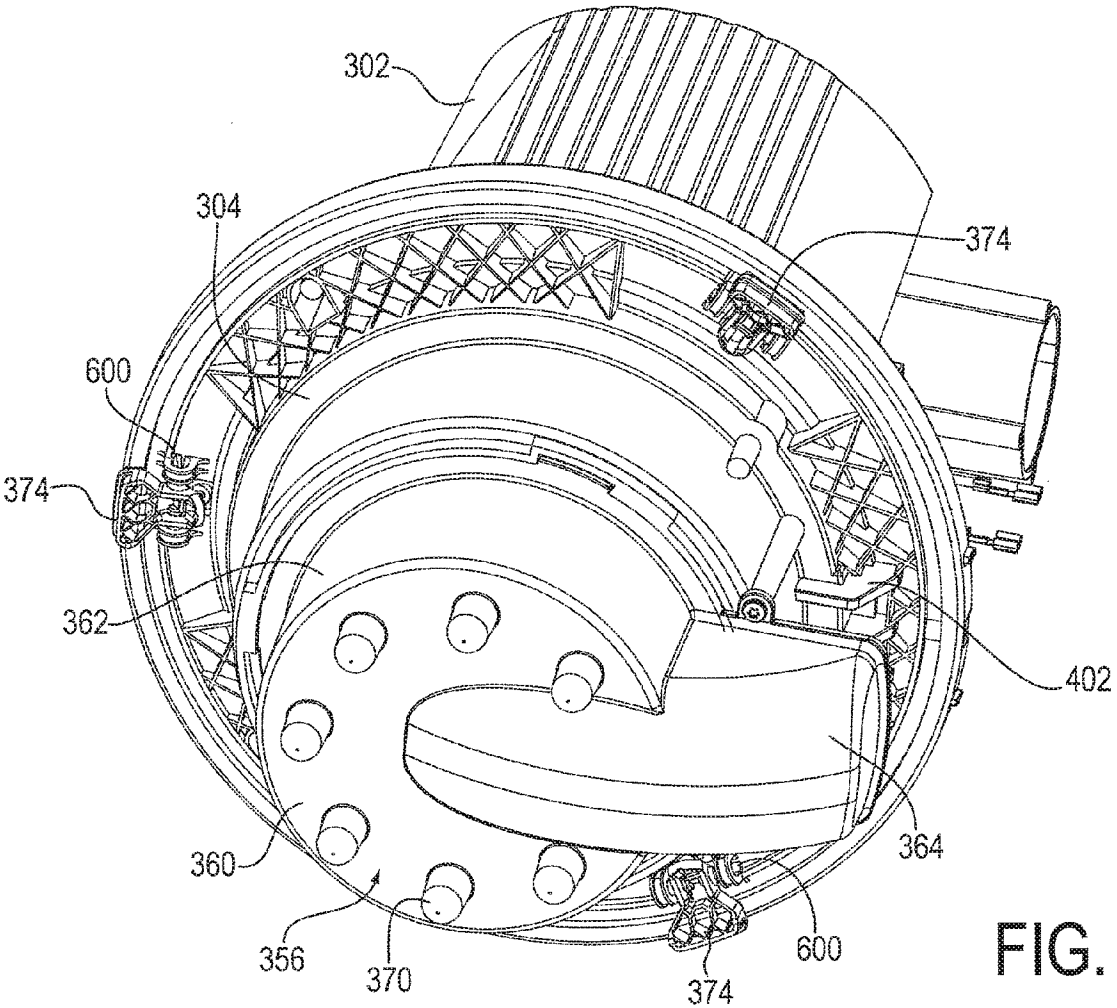
FIG. 6 is a bottom isometric view of the motor module of FIG. 3.

Electric power is provided to the suction motor 300 by power wires 344. The power wires 344 pass through the motor module 200 to reach an electronic control unit 346 ("ECU") or other control device (e.g., a simple electric switch). In addition, an overload protection device, such as a thermal cutoff unit 348 may be provided in the motor module 200, and this also may include electric wires 350 that pass outside the motor module 200. The wires 344, 350 may pass through an opening that is sealed by a grommet, or may pass through a notch or gap in the motor housing gasket 328. More preferably, the motor module 200 includes one or more electric bridges 402 (FIG. 4) comprising corresponding pairs of electrically-joined motor module connectors 404. A separate electric bridge 402 is provided for each wire that needs to pass through the motor module 200. In the shown embodiment, each electric bridge 402 comprises a single strip of conductive metal that is directly molded into the lower motor housing shell 304, and there are three in total (e.g., for positive, negative and ground circuits). In this embodiment, the lower motor housing shell 304 is molded into rib-shaped projections that contain the electric bridges 402, as best shown in FIG. 6. The electric bridges 402 each pass from the positive-pressure side of the motor module 200 to an upper side of the mounting flange 308, but other locations may be used in other embodiments.

It will be appreciated that other embodiments may use other constructions for the electric bridges 402. For example the electric bridges 402 may comprise flexible wires instead of the shown strip-like ribbons of conductive material. The electric bridges 402 also may comprise conductive strips that are pressed into slots in the upper or lower motor housing shell 302, 304 instead of being molded in place. The electric bridges 402 also may comprise one or more separate parts that are mounted to either shell 302, 304. For example, the electric bridges 402 may be separately molded in a more compact or more efficient molding operation, and joined to the upper or lower motor housing shell 302, 304 during final assembly of the unit.

The motor module 200 may include other components in addition to those described above. For example, it may include a post-motor filter mount and corresponding filter, or one or more sensors to detect air pressure or other operating conditions. The motor module 200 also may include operation indicators, such as lights that are turned on when the suction motor is operating or ready to operate. For example, the exemplary embodiment includes a ring 352 having a number of light emitting diodes (LEDs) to indicate operating conditions, suction motor status, or simply that the cleaner module 100 is connected to a power supply. The ring 352 may be mounted in a corresponding slot on the lower motor housing mounting flange 308, and powered by a dedicated electric wire 354.

As shown in FIG. 4, the suction motor inlet 406 is fluidly connected to a suction chamber 408. The suction chamber 408 may include a filter bag 202 or other dirt separation device to clean the air passing through the cleaner module 100, such as a cyclone separator. In the shown embodiment, the suction chamber 408 includes a filter bag 202 mounted below the motor module 200. The filter bag 202 is pliable, and moves up when suction is applied, and drops back down when the suction is turned off. A weight 410 may be sewn into or otherwise incorporated into the filter bag 202 to ensure that the filter bag 202 drops whenever suction is turned off. This action helps shake entrapped dirt out of the filter bag 202.

In a typical motor module arrangement, the suction motor inlet 406 is adjacent the suction motor's impeller shroud 316, and forms an opening that surrounds an impeller axis 412. The impeller axis 412 is the axis which one or more impellers located within the shroud 316 rotate, typically at very high speeds. The opening typically comprises a circular hole that is flat, and lies in a plane that is perpendicular to the impeller axis 412. This permits relatively unrestricted ingress of air, but also allows high-frequency sound waves generated by the impeller and motor to propagate through the opening relatively unabated.

The suction motor inlet 406 may be covered by an inlet cover 356. The inlet cover 356 may be connected to the bottom of the lower motor housing shell 304 or formed integrally therewith, or may be connected to other parts, such as the inner walls of the main housing 102. The exemplary inlet cover 356 forms an inlet chamber 358 located immediately below the suction motor inlet 406. The inlet chamber 358 has a closed bottom wall 360 that is connected to the lower motor housing shell 304 by a sidewall 362, which, in this example, has a generally cylindrical shape. Screws, tabs, or other fasteners may be used to connect the inlet cover 356 to the lower motor housing shell 304 or other parts to hold the inlet cover 356 in place during use. The bottom wall 360 blocks direct airflow from the suction chamber 408 to the suction motor inlet 406, and indirect airflow may be generally prevented by the sidewall 362.

An inlet passage 364 fluidly connects the suction chamber 408 to the suction motor inlet 406. In the shown embodiment, the inlet passage 364 extends sideways from the first portion 358 and terminates at an inlet cover opening 366. The inlet passage 364 may have any length, and may comprise a simple hole through the side of the inlet cover 356. The inlet passage 364 may include a curved lower wall 368 to help turn incoming air towards the suction motor inlet 406. Other features also may be used to encourage efficient air flow through the suction motor cover 406. For example, the inlet passage 364 may intersect the cylindrical first portion 358 at an angle, such that the incoming airflow tends to form a swirling airflow that might enter the suction motor inlet 406 with less pressure drop within the inlet cover 356. As another example, the inlet cover opening 366 may comprise an outwardly-flared lip (i.e., a terminating lip that is curved or angled outwards from the opening 366), such as shown, to encourage the efficient entry of air. Other embodiments also may include multiple inlet passages 364 or inlet cover openings 366. For example, the inlet cover 356 may have two diametrically-opposed inlet passages 364 with respective inlet cover openings 366. Each of the one or more inlet cover openings 366 also may include a grate, rib, or other structure to prevent the ingress of large objects.

The inlet cover opening 366 preferably is oriented to prevent the filter bag 202 from occluding the inlet cover opening 366 during operation. For example, the inlet cover opening 366 may face laterally (i.e., perpendicular to the impeller axis 412), directly upwards (i.e., parallel to the impeller axis 412, but facing in the opposite direction as the suction motor inlet 406) or at an upwards angle (i.e., at an angle between perpendicular to the impeller axis 412 and up to and including directly upwards). As understood herein, the inlet cover opening 366 "faces" in the direction from which it primarily receives the incoming airflow. A directly upwards orientation, such as shown in FIG. 4, is one preferred orientation for the inlet cover opening 366, as it minimizes the likelihood that the bag 202 will occlude the inlet cover opening 366. In this embodiment, the inlet cover opening 366 comprises a perimeter edge that lies in a plane that is perpendicular to the impeller axis 412, but the perimeter edge may include notches or other deviations from this imaginary plane in other embodiments.

The inlet cover 356 may provide one or more benefits. First, the solid bottom wall 360 may be located on the impeller axis 412, such that it overlies the suction motor inlet 406 as the parts are viewed along the impeller axis 412. This arrangement is expected to help block or absorb high-frequency sounds that typically emit from the suction motor inlet 406. To enhance this effect, it may be desirable to coat the inner surface of the bottom wall 360 with sound absorbing material (not shown), such as foams or the like, but in a preferred embodiment the inlet cover 356 does not include any internal filters or foam materials to optimize airflow. Offsetting the inlet cover opening 366 from the impeller axis 412 and orienting it upwards also may enhance this sound reduction effect by providing a more difficult exit path for reflected sound waves.

Orienting the inlet cover opening 366 so that it is not facing towards the filter bag 202 also reduces or eliminates any risk that the filter bag 202 will block the inlet cover opening 366. Thus, even if the bag 202 is large enough to press against the bottom of the inlet cover 356, air passing around the lower motor housing shell 304 can readily enter the inlet cover opening 366 to maintain airflow. This also may help distribute the airflow throughout the suction chamber 408 and more efficiently use all of the filter bag material to filter the air. For example, in the shown embodiment, the lower motor housing shell 304 and inlet cover 356 protrude downward into the suction chamber 408, forming a ring-shaped, circumferential space 416 above the bag 202 and between the main housing 102 and the lower motor housing shell 304 and inlet cover 356. The inlet cover opening 366 faces this circumferential space 416. The circumferential space 416 distributes the low-pressure air and airflow generated by the suction motor around the perimeter of the suction chamber 408, potentially increasing the distribution of airflow through the surface of the bag 202 and more fully using the bag's dirt-holding capacity.

Variations on the foregoing circumferential space 416 construction will be readily appreciated in view of the present teachings. For example, if the suction motor inlet 406 is flush with the upper end of the suction chamber 408

(e.g., if the lower motor housing shell is flat instead of having a recess 306), the circumferential space 416 may be formed entirely be the inlet cover 356, such as by extending the sidewall 362 upwards above the inlet cover opening 366. Also, in other embodiments, the circumferential space 416 may extend only partly around the perimeter of the suction chamber, or it may be interrupted by ribs or other structures.

The inlet cover 356 may provide additional benefits. For example, a further benefit may be provided by locating the inlet cover opening 366 immediately below the ribs containing the electric bridges 402, as shown in FIG. 4, to ensure a constant flow of air to cool the electric bridges 402. Also, if desired, offset structures, such as short posts 370 or ribs, may be provided on the bottom of the inlet cover 356 to allow air to pass along the bottom of the inlet cover, and allow air to filter through the part of the filter bag 202 located immediately below the inlet cover 356.

It will be appreciated that the inlet cover 356 may be constructed with a variety of shapes. For example, the construction shown may be replaced by a bent tube, such as a J-shaped tube that extends downward from the suction motor inlet 406 and bends to the side or back up towards the motor module 200. As another example, the inlet cover 356 may comprise a flat panel installed below the suction motor inlet 406. Such a panel may extend across the entire width of the main housing 102, or be located in a discrete region such as a disk directly below the suction motor inlet 406. Other variations and modifications will be In contrast to the exemplary embodiments, conventional central vacuum devices typically have an uncovered, downward-facing suction motor inlet, and measures must be taken to prevent the bag from blocking the inlet. Such blockage can reduce performance and may leading to bag or motor damage. Conventional devices dimension the parts to provide a space between the bag and the inlet, or provide ribs or other structures to hold the bag away from the inlet. However, these solutions may have drawbacks. For example, the airflow may tend to pass primarily through the center of the filter bag, leaving other portions of the bag relatively unused, and it may be necessary to make the assembly relatively tall and less compact to space the bag from the inlet. Such devices also lack the sound-absorbing qualities of the system described above.

FIG. 4 shows the motor module 200 as it appears when it is assembled with the main housing 102. The exemplary motor module 200 preferably is mounted in the main housing 102 by the mounting flange 308. As noted above, the mounting flange 308 may be part of the lower motor housing shell 304, but it may instead be a separate part, or part of the upper motor housing shell 302. In the shown example, the mounting flange 308 rests on a shelf 414 located inside the main housing 102. The shelf 414 may comprise a plurality of projections, or a single continuous projection. Where the main housing 102 is made of metal, the shelf 414 may be formed as a bead (such as shown), as tabs bent from punched holes, or through other metal-forming processes. In plastic main housings 102, the shelf 414 may be molded in place. In either case, the shelf 414 also may be a separate part that is installed in place. The shelf 414 and mounting flange 308 are positioned such that the motor module 200 is located almost entirely within the main housing 102. This may help suppress operating noise by providing an airspace between the motor module 200 and the main housing 102, and using the main housing 102 as an extra barrier to reduce sound transmission. In other embodiments, however, the shelf 414 and mounting flange 308 may be positioned such that the upper part of the motor module 200 extends partially or entirely outside the main housing 102.

Figure 5A:
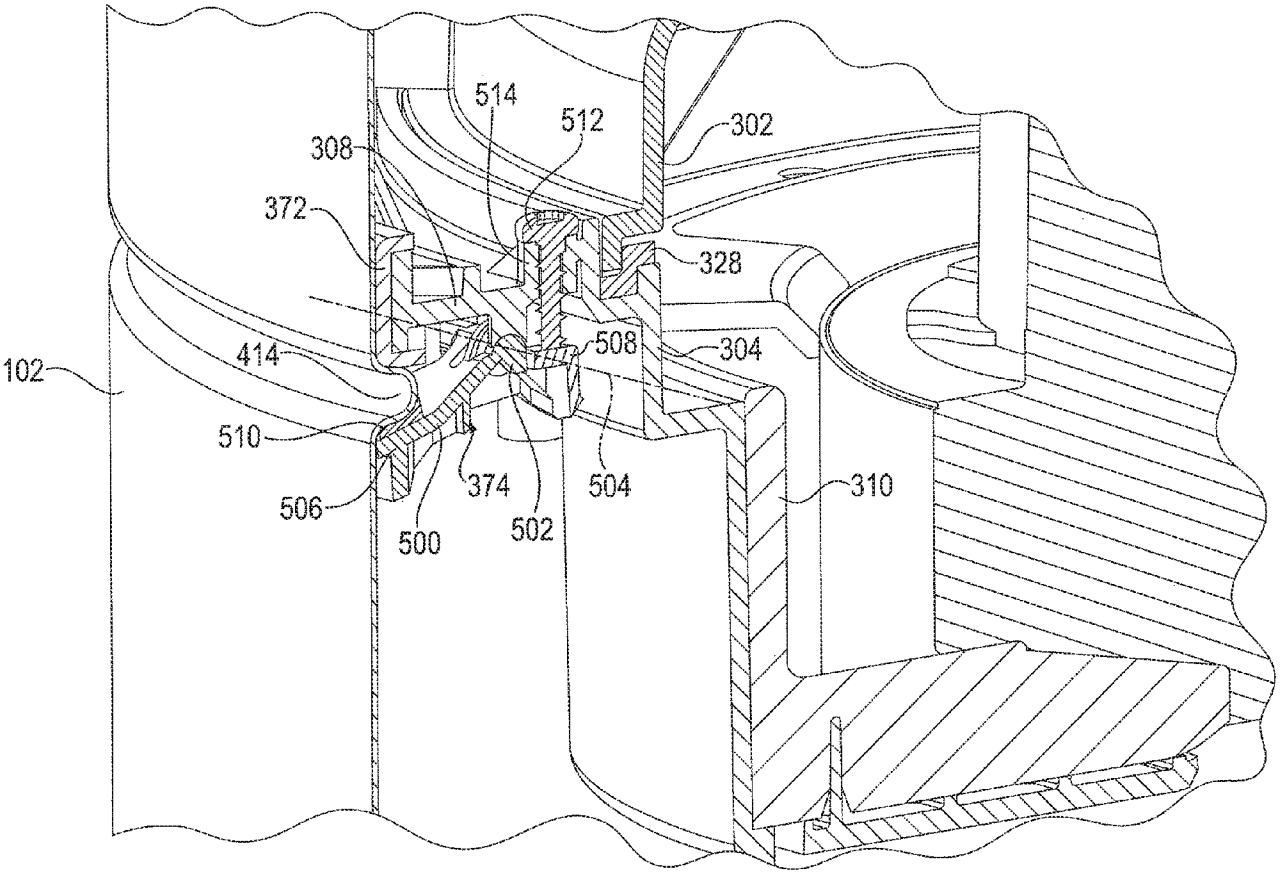
FIG. 5A is a partially cutaway view of an exemplary toggle clamp arrangement, shown with the toggle clamp in the clamped position.
Figure 5B:
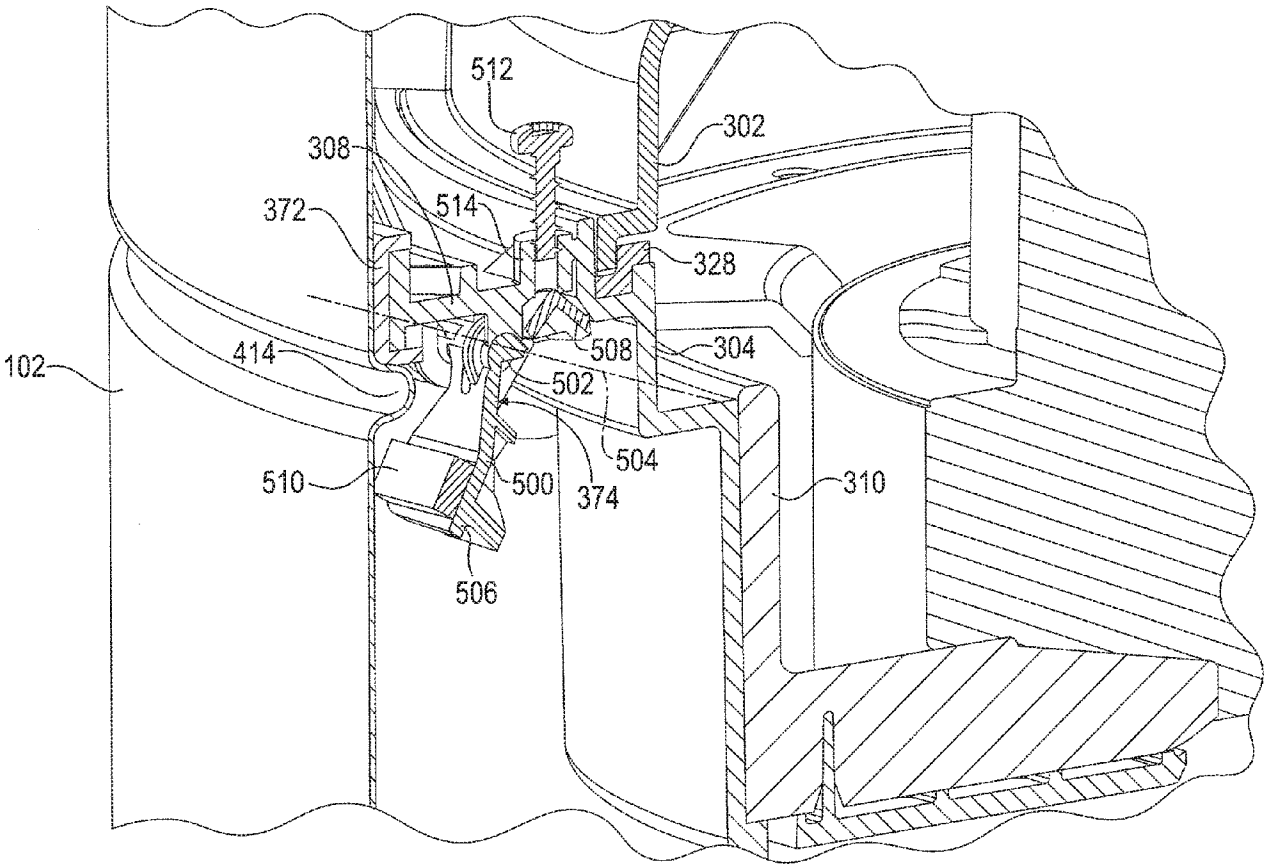
FIG. 5B is a partially cutaway view of the toggle clamp arrangement of FIG. 5A, shown with the toggle clamp in the open position.

The mounting flange 308 may include a flange gasket 372 that fits between the mounting flange 308 and the shelf 414. The flange gasket 372 preferably forms a leak-resistant seal, and also may absorb operating noise that would otherwise pass from the motor module 200 to the main housing 102. Suitable materials for the flange gasket 372 may include a ⅛-inch thick strip of dense ethylene propylene diene rubber ("EPDM") or the like. As shown in FIGS. 5A and 5B, the flange gasket 372 also may wrap around the sides of the mounting flange 308 to seal against the inner sidewall of the main housing 102.

Referring to FIGS. 5A, 5B and 6, the mounting flange 308 preferably is connected to the shelf 414 by one or more toggle clamps 374, and most preferably by three equiangularly spaced toggle clamps 374. Each toggle clamp 374 comprises a rocker arm 500 that is pivotally connected to the bottom of the mounting flange 308, such as by pivot pins 502 that extend laterally from the rocker arm 500 and into corresponding pivot holes 600 (FIG. 6) on the mounting flange 308. The pivot pins 502 and pivot holes may be oriented to form a rocker arm axis 504 that is generally parallel with the surrounding edge of the mounting flange 308. A first end 506 of the rocker arm 500 extends between the rocker arm axis 504 and the outer edge of the mounting flange 308, and a second end 508 of the rocker arm 500 extends from the rocker arm axis 504 away from the outer edge of the mounting flange 308.

The rocker arm 500 is rotatable about the rocker arm axis 504 between a clamped position in which the first end 506 is raised and the second end 508 is lowered (FIG. 5A), and an open position in which the first end 506 is lowered and the second end 508 is raised (FIG. 5B). In the clamped position, the first end 506 contacts and presses against the bottom of the shelf 414, to prevent the motor module 200 from being lifted out of the main housing 102. In the open position, the first end 506 is clear of the shelf 414 by sufficient distance to permit installation and removal of the motor module 200. If desired, a resilient mounting pad 510 may be provided between the first end 506 of the rocker arm 500 and the shelf 414, to allow some flexure during installation and to absorb some of the vibrations that might otherwise pass from the motor module 200 to the main body 102. For example, the mounting pad 510 may be a strip of ⅛-inch thick urethane micro-cell foam material that is adhesively bonded to the top face of the first end 506 of the rocker arm 500.

Any suitable mechanism may be used to move the rocker arm 500 into the clamped position. The exemplary embodiment uses a screw 512. The screw 512 fits into a threaded boss 514 on the mounting flange 308, with a bottom end of the screw 512 adjacent the second end 508 of the rocker arm 500. Advancing the screw 512 into the boss 514 presses the second end 508 down and moves the first end 506 up, to place the rocker arm 500 into the clamped position, as shown in FIG. 5A. The screw 512 is reversed out of the boss 514 to permit the second end 508 to rise and the first end 506 to drop, to allow the rocker arm 500 to drop into the open position, as shown in FIG. 5B.

It will be appreciated that the foregoing arrangement of an exemplary toggle clamp 374 may be modified in various ways. For example, the screw 512 and boss 514 may be provided on the second end 508 of the rocker arm 500 to press against the mounting flange 308, in which case the screw 512 may be accessed from below instead of from above the mounting flange 308. As another example, the second end 508 of the rocker arm 500 may be omitted, and the screw 512 may be used to lift the first end 506 of the rocker arm 500 upwards towards the shelf 414. In this latter example, the screw 512 could pass through an unthreaded hole in the mounting flange 308, and engage a threaded boss in the first end 506 of the rocker arm 500. The rocker arm 500 also may be actuated by a mechanism located outside the main housing 102. For example, the second end 508 may extend vertically through the mounting flange 308, and be moved into the clamped position by a screw that is threaded horizontally or at an angle through a threaded boss in the main housing sidewall.

It will also be appreciated that other embodiments may use other connection mechanisms to hold the motor module 200 in place. For example, screws may be driven sideways through the main housing 102 sidewall directly into to the mounting flange 308, or screws may be passed vertically through the mounting flange 308 and threaded into the shelf 414. As another example, the toggle clamps 374 may be formed as rotating wedges that are rotated about a vertical axis to move them under the shelf 414. Other variations and modifications will be apparent to persons of ordinary skill in the art in view of the present disclosure.

Figure 7:
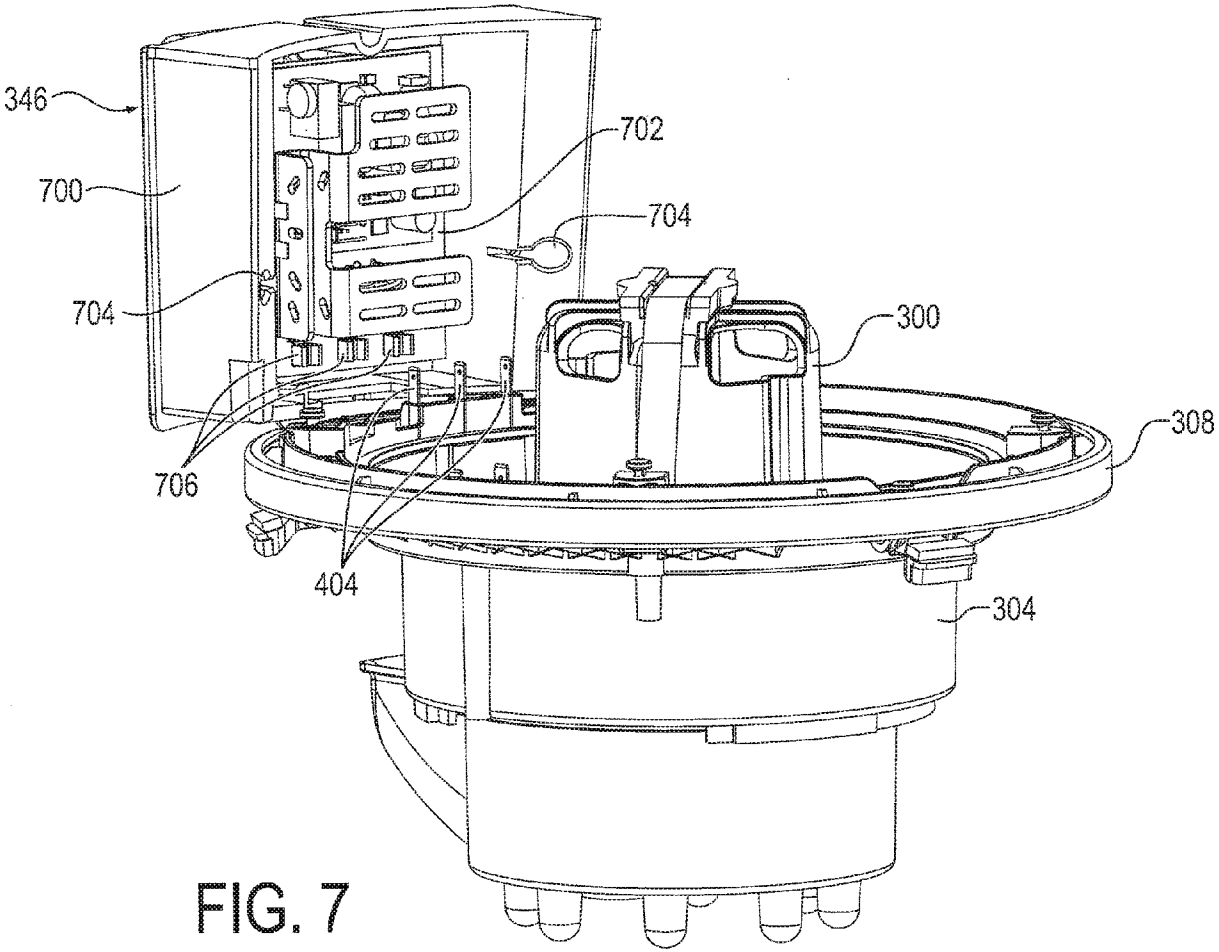
FIG. 7 is an isometric view of the ECU and portions of the motor module of FIG. 3.

Referring now to FIGS. 3 and 7, embodiments of a cleaner module 100 may include a removable ECU 346. The ECU 346 includes circuitry that communicates with or controls the suction motor 300 and other devices, such as remote cleaning heads and the like. Conventional central vacuum cleaner ECUs typically are hard-wired to the suction motor, and oftentimes are structurally connected to the cleaner in a way that does not permit simple inspection, servicing and replacement. This is often done to prevent inadvertent exposure to the electronics, and for expedience in manufacturing the motor assembly. It is also common for different ECUs to be used in different models of a product line of central vacuum cleaners, in which case each product may have its own unique ECU, but various other components in common with other models in the product line. It is expected that providing a readily-removed ECU 346 can provide several benefits. For example, the ECU can be easily removed for servicing or replacement, to upgrade the product model to include additional features, to reconfigure the device to accept a different input voltage (e.g., 240 volts instead of 120 volts), or to provide an updated operating system.

The exemplary ECU 346 is removably mounted to the outer surface of the upper motor housing shell 302. The ECU comprises an ECU shell 700 in which one or more circuit boards 702 and other electronics are contained. One side of the ECU shell 700 is exposed and forms a portion of the outer surface of the cleaner module 100. The outer perimeter of the exposed surface may be contoured to join with the surrounding outer surface of the cleaner module 100. The side of the ECU shell 700 facing the upper motor housing shell 302 may be open, as this side is closed off when the ECU 346 is mounted in place. Vent holes, seals, cooling fans, and other features may be provided in the ECU 346 as desired.

The ECU 346 preferably is mounted to the cleaner module 100 so that it can be removed without otherwise disassembling the cleaner module 100. However, the ECU 346 may optionally be covered by a removable access door, housing cover, or panel. The ECU 346 may be connected to the cleaner module 100 using any suitable arrangement of connectors. For example, simple screws can be used. In a preferred embodiment the ECU 346 is slidingly mated with the upper motor housing shell 302. For example, the ECU shell 700 may have a pair of mounting holes 704 that slide over corresponding mounting posts 376 on the upper motor housing shell 302. The ECU shell 700 also may include a groove 378 that fits under a corresponding rib 380 on the bottom of the air outlet 330 to help hold the ECU 346 in place. The ECU 346 is installed by sliding it laterally onto the mounting posts 376, and may be secured in place by one or more screws, hooks, or the like.

The ECU 346 is electrically connected to the suction motor 300 and other electronics by ECU connectors 706 that engage the motor module connectors 404 protruding from the mounting flange 308. The connection is made automatically as the ECU 346 is slid over the mounting posts 376. To ensure proper alignment between the ECU connectors 706 and their respective motor module connectors 404, the mounting posts 376 and mounting holes 704 may be dimensioned to place the ECU 346 in the proper orientation relative to the upper motor housing shell 302 well before the ECU connectors 706 mate with the motor module connectors 404. The ECU connectors 706 in the shown embodiment comprise spring-type sockets comprising a pair electrically conductive leaf springs that abut each other to form an openable slot to receive the flat motor module connector 404. Other embodiments may use other kinds of electrical connectors, such as pins that fit into corresponding sockets, and the like. In other embodiments, the locations of the ECU connectors 706 and motor module connectors 404 may be swapped (e.g., spade connectors on the ECU and spring connectors on the motor module), and they may be arranged in any suitable pattern. In other embodiments, the ECU and motor module connectors 404 may be replaced by a flexible wiring harness that is connected before sliding the ECU 346 in place.

The side of the ECU 346 that faces outside the cleaner module 100 preferably includes an input power jack 382 to connect to a power cable. The type of power jack 382 may vary depending on the country in which the cleaner module 100 is to be used. The ECU 346 may be easily replaced to change the power jack 382 to the one necessary for the desired location. The exposed side of the ECU 346 also may include one or more auxiliary inputs 384, which may connect to a control switch, a radio frequency antenna, or low-voltage electrical control lines associated with the network of suction pipes for remotely controlling the ECU 346. Control panels and indicators also may be provided on the exposed side of the ECU 346.

Figure 8:
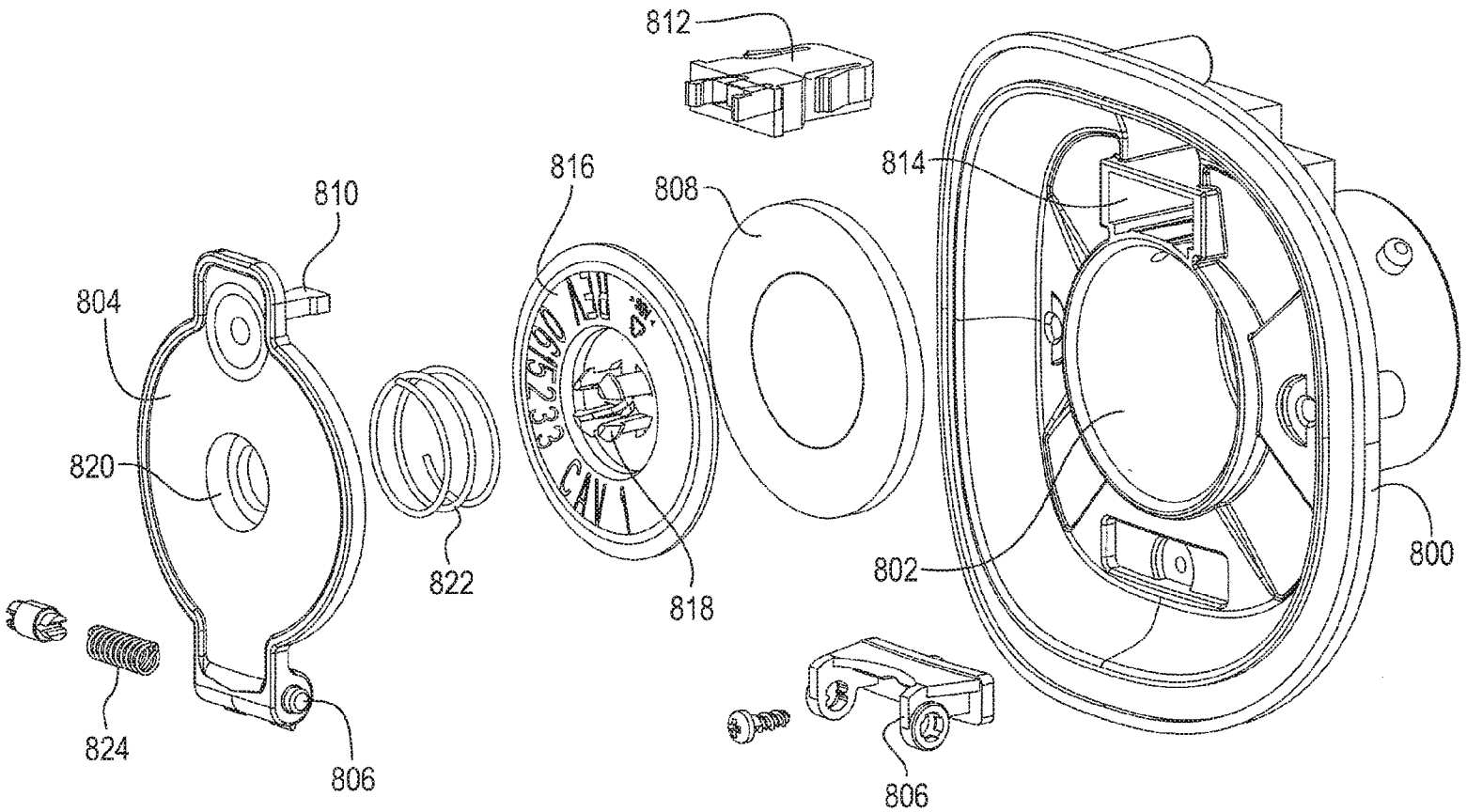
FIG. 8 is an exploded view of an exemplary utility port.

Referring now to FIG. 8, the cleaner module 100 may include a utility port 110 that leads directly into the suction chamber. The utility port 110 may be connected to a hose for cleaning in the immediate proximity of the cleaner module 100. When it is not in use, the utility port 110 is sealed to prevent air from leaking into the suction chamber, which could reduce cleaning performance at remote locations. The utility port 110 may be integrally formed with the main housing 102 or a dirt receptacle 106 (which may be preferable if the main housing 102 or dirt receptacle 106 are made of plastic), but alternatively may be provided as a separate port fitting 800 that fits into a corresponding hole through the main housing 102 and is secured by screws or other fasteners. In the shown embodiment, the port fitting 800 is mounted into a stamped hole through a metal main housing 102 sidewall. A rubber grommet or other seal may be provided between the port fitting 800 and main housing 102 to prevent air from leaking though this junction.

The port fitting 800 includes a suction opening 802 that leads into the suction chamber. The suction opening is selectively covered by a utility port door 804 that is pivotally connected to the port fitting 800 by a hinge 806. A door seal 808 is provided to seal between the port door 804 and the suction opening 802 when the port door 804 is closed. The door seal 808 may be mounted on the end of the suction opening 802, but more preferably is mounted on the port door 804.

The port door 804 may be locked in the closed position by any suitable latch mechanism, but in a preferred embodiment it is secured by a tab 810 on the port door 804 that engages a push-push latch 812 mounted in a corresponding socket 814 the port fitting 800. Push-push latches alternately lock and unlock with successive pushes towards the latch body. Thus, they are simple and intuitive to use. Such devices are known in the art, and an example is provided in U.S. Pat. No. 5,292,158, which is incorporated herein by reference. While the benefits of push-push latches 812 are known, they pose a problem when used on a port door 804 that covers a suction chamber; namely, the suction applied to the back side of the port door 804 can pull with sufficient force to unlatch the push-push latch 812. To prevent this from happening, the door seal 808 is mounted on a floating plate 816 that is mounted on the port door 804 so that it can move relative to the port door 804. In the shown embodiment, the floating connection is provided by a post 818 that extends from the floating plate 816 and snaps into a hole 820 on the port door 804. The post 818 is long enough to allow the floating plate 816 to move back and forth along the post 818 by a short distance. A spring 822 located between the floating plate 816 and the port door 804 biases the floating plate 816 away from the port door 804. Another spring 824 may be provided to bias pivot the port door 804 towards the open position to help ensure positive action of the push-push latch 812 and to open the door after the push-push latch 812 is released.

With the arrangement shown in FIG. 8, suction is applied to the floating plate 816 when the port door 804 is closed, and there is sufficient free movement between the floating plate 816 and the port door 804 that the suction does not pull on the port door 804 itself. Thus, the suction cannot activate the push-push latch 812 to open the port door 804. The spring 822 ensures that the floating plate 816 and door seal 808 are placed in contact with the suction opening 802 when the port door 804 is closed. In use, the operator simply pushes the port door 804 towards the port fitting 800 to open or close the port door 804. The spring 822 compresses to permit the port door 804 and tab 810 to move towards the port fitting 800 to engage and disengage the push-push latch 812. Successive pushes latch and unlatch the tab 810 with the push-push latch 812, as known in the art of such devices. If desired, a separate spring (not shown) may be provided to push the port door 804 open when it is unlatched.

It will appreciated that the foregoing embodiment may be modified in various ways. For example, the door seal 808 may be mounted on the port fitting 800 surrounding the suction opening 802. As another example, the floating plate 816 may be mounted to the port door 804 by a pivoting mount or other movable connection. Other variations and modifications will be apparent to persons of ordinary skill in the art in view of the present disclosure. It will also be appreciated that the utility port 110 may be used in other kinds of vacuum cleaners, such as upright and canister vacuum cleaners, as an accessory cleaning hose port.

As noted above, some embodiments of a cleaner module 100 may use filter bags 202 to separate dirt from the flow of air. Conventional filter bags typically comprise a bag of filter material that terminates at a mounting ring. The mounting ring is formed of a band of flexible material having a round cross-sectional profile (e.g., a toroid shape like a large O-ring). The filter material at the open end of the bag typically is wrapped completely around the mounting ring's cross section, and may wrap around far enough to be secured to itself. Thus, the mounting ring is completely encapsulated by the filtration material. These filter bags are mounted in groove or bead that protrudes radially-outwardly from the cleaner module's suction chamber. While such devices have worked well, it has been found that wrapping the filter material around the mounting ring can permit some air to leak between the mounting ring and the inner wall of the suction chamber. This is believed to happen as a result of the filter material's bulk and tendency to bunch up during the act of flexing the mounting ring to place it inside the groove.

Figure 9:
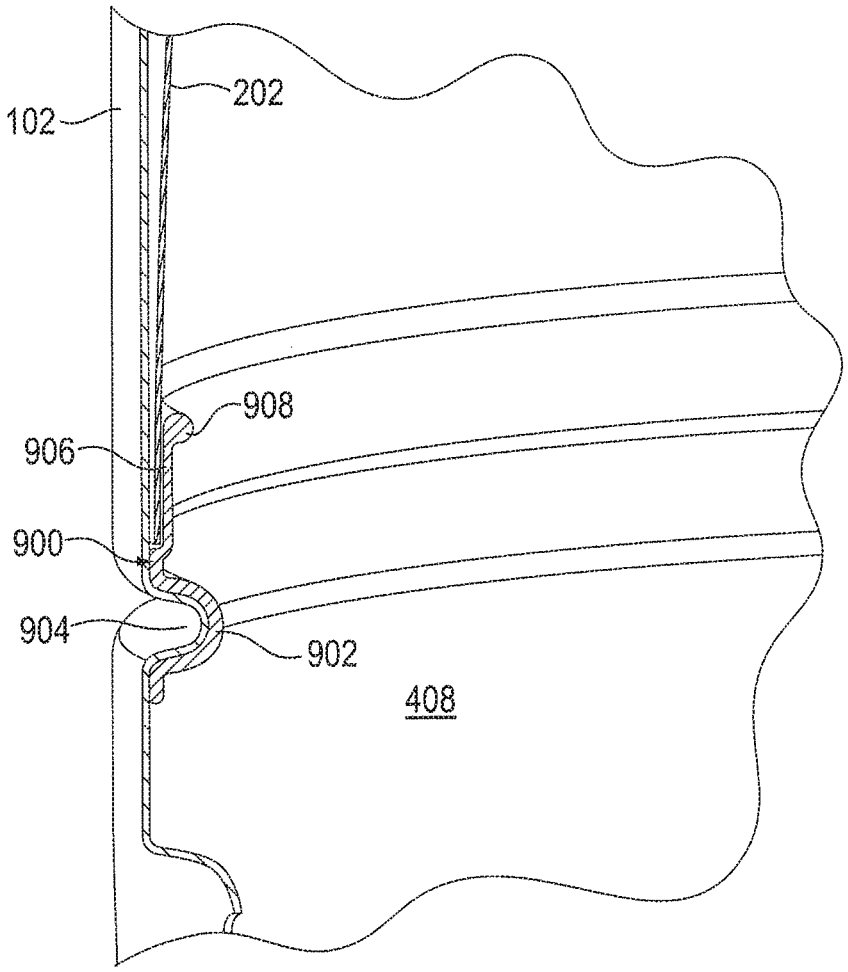
FIG. 9 is a cross-sectional view of an exemplary filter bag seal that may be used with embodiments of central vacuum cleaner modules.

An alternative embodiment of a filter bag 202, which is expected to help address the problem of leaking around the mounting ring, is illustrated in FIG. 9. In this embodiment, the filter bag 202 is mounted to the main housing 102 by a mounting ring 900 that is connected to the open end of the filter bag 202. The mounting ring 900 may comprise thermoplastic vulcanized rubber ("TPV"), or other flexible structures suitable for form an air-resistant seal with the wall of the main housing 102. The mounting ring 900 includes an inwardly-extending groove 902 that fits over a corresponding inwardly-extending bead 904 formed on the inner wall of the suction chamber 408. The mounting ring 900 also includes an upwardly-extending leg 906. A reinforcing ring 908 of thicker material may be provided along or at the top of the leg 906 to stiffen the upper portion of the mounting ring 900. The filter material that forms the filter bag 202 is connected to the leg 906, and thus does not interfere with the seal between the groove 902 and the bead 904. The filter material may be connected to the inner surface of the leg 906, but more preferably is connected to the outer surface, such as shown. The filter material may be connected by adhesives, stitches or other fasteners, ultrasonic welds, or any combination of these or other attachments.

The filter bag 202 shown in FIG. 9 is installed by compressing the mounting ring 900 and sliding it upwards into the main housing 102 until the groove 902 overlies the bead 904. The mounting ring 900 is then released, and adjusted as necessary to make sure the groove 902 fits tightly over the bead 904. Once in place, the filter material is located above the sealing junction between the filter bag 202 and the main housing 102, and does not interfere with the seal.

It will be appreciated that variations may be made to the foregoing embodiment. For example, the groove 902 and bead 904 are shown as single rounded shapes, but they may be rectilinear, or comprise multiple protrusions or interlocking shapes. Other materials for the mounting ring 900 or mechanisms to bond the mounting ring 900 to the filter material may be used, as well. Other variations and modifications will be apparent to persons of ordinary skill in the art in view of the present disclosure.

The present disclosure describes a number of new, useful and nonobvious features and/or combinations of features that may be used alone or together. The embodiments described herein are all exemplary, and are not intended to limit the scope of the inventions. It will be appreciated that the inventions described herein can be modified and adapted in various and equivalent ways. For example, while the embodiments disclosed herein are directed to central vacuum cleaners, they may be adapted for use with other kinds of vacuum cleaner, such as upright or canister vacuum cleaners or the like. These and other modifications and adaptations that will be appreciated in view of the present disclosure are intended to be included in the scope of this disclosure and the appended claims.

I claim:

1. A central vacuum cleaner comprising:

a main housing;

a suction chamber located inside the main housing;

a shelf extending from the main housing into the suction chamber;

a suction chamber inlet providing a fluid passage through the main housing into the suction chamber;

a suction motor having a suction motor inlet in fluid communication with the suction chamber and configured to generate a flow of air from the suction chamber inlet to the suction chamber and into the suction motor inlet; and at least one clamp operatively associated with the suction motor and configured to releasably engage the shelf to connect the suction motor to the main housing.

2. The central vacuum cleaner of claim 1, wherein the at least one clamp comprises three clamps equally spaced around a perimeter of the suction motor within the main housing.

3. The central vacuum cleaner of claim 1, further comprising a mounting flange extending from the suction motor towards the main housing, wherein the at least one clamp is positionable to hold the shelf between the at least one clamp and the mounting flange to connect the suction motor to the main housing.

4. The central vacuum cleaner of claim 3, further comprising a mounting flange gasket positioned between the mounting flange and the main housing to form a leak resistant seal between the suction chamber and an upper portion of the main housing.

5. The central vacuum cleaner of claim 4, wherein the at least one clamp comprises a resilient member positioned adjacent the shelf when the clamp is positioned to hold the shelf between the at least one clamp and the mounting flange, the resilient member and the mounting flange gasket being selected from one or more materials to reduce transmission of vibrations from the suction motor to the main housing.

6. The central vacuum cleaner of claim 3, wherein the at least one clamp comprises a rocker arm connected to the mounting flange at a pivot, the rocker arm being pivotable between a locked position in which the shelf is held between the a first end of the rocker arm and the mounting flange, and an unlocked position in which the shelf is not held between the first end of the rocker arm and the mounting flange.

7. The central vacuum cleaner of claim 6, wherein the at least one clamp further comprises a screw threaded into one or the other of the mounting flange and the rocker arm, and positioned to move the rocker arm from the unlocked position to the locked position upon rotation of the screw.

8. The central vacuum cleaner of claim 7, wherein the screw is threaded in a hole in the mounting flange and positioned to contact a second end of the rocker arm.

9. The central vacuum cleaner of claim 8, wherein the rocker arm is positioned on a first side of the mounting flange, the screw extends through the mounting flange to a second side of the mounting flange, and the screw is operable from the second side of the mounting flange.

10. The central vacuum cleaner of claim 9, wherein the first side of the mounting flange is located in the suction chamber, and the second side of the mounting flange is located outside the suction chamber.

11. The central vacuum cleaner of claim 3, wherein the mounting flange is located above the shelf and the clamp is located below the shelf when the at least one clamp is positioned to hold the shelf between the at least one clamp and the mounting flange to connect the suction motor to the main housing.

12. A central vacuum cleaner comprising:

a main housing;

a suction chamber located inside the main housing;

a shelf extending from the main housing into the suction chamber;

a suction chamber inlet providing a fluid passage through the main housing into the suction chamber;

a suction motor having a suction motor inlet in fluid communication with the suction chamber and being configured to generate a flow of air from the suction chamber inlet to the suction chamber and into the suction motor inlet;

a mounting flange extending from the suction motor towards the main housing; and a plurality of clamps, each clamp being movably mounted to the mounting flange and having a first end movable between a locked position in which the shelf is held between the first end and the mounting flange, and an unlocked position in which the shelf is not held between the first end and the mounting flange.

13. The central vacuum cleaner of claim 12, further comprising a mounting flange gasket positioned between the mounting flange and the main housing to form a leak resistant seal between the suction chamber and an upper portion of the main housing.

14. The central vacuum cleaner of claim 13, wherein each of the plurality of clamps comprises a resilient member positioned at the first end and adjacent the shelf when the clamp is in the locked position.

15. The central vacuum cleaner of claim 12, wherein each of the plurality of clamps comprises a rocker arm connected to the mounting flange at a pivot.

16. The central vacuum cleaner of claim 15, wherein each of the plurality of clamps comprises a screw threaded into one or the other of the mounting flange and the rocker arm, and positioned to move the rocker arm from the unlocked position to the locked position upon rotation of the screw.

17. The central vacuum cleaner of claim 16, wherein the screw is threaded in a hole in the mounting flange and positioned to contact a second end of the rocker arm.

18. The central vacuum cleaner of claim 17, wherein the rocker arm is positioned on a first side of the mounting flange, the screw extends through the mounting flange to a second side of the mounting flange, and the screw is operable from the second side of the mounting flange.

19. The central vacuum cleaner of claim 18, wherein the first side of the mounting flange is located in the suction chamber, and the second side of the mounting flange is located outside the suction chamber.

20. The central vacuum cleaner of claim 12, wherein the mounting flange is located above the shelf and the clamp is located below the shelf when the plurality of clamps are in the locked position.

21. The central vacuum cleaner of claim 12, further comprising a pliable gasket interposed between the suction motor and the mounting flange.

22. The central vacuum cleaner of claim 12, wherein the suction motor is enclosed within a motor housing, the mounting flange extends outward from the motor housing, and the motor housing, mounting flange and suction motor are removable as a unit from the main housing when the plurality of clamps are in the unlocked position.

* * * * *